US006363527B1

(12) United States Patent
Biermann et al.

(10) Patent No.: US 6,363,527 B1
(45) Date of Patent: Apr. 2, 2002

(54) THERMAL CONTROL APPARATUS FOR BODY ARMOR

(75) Inventors: Paul J. Biermann, Columbia; Matthew G. Bevan, Silver Spring, both of MD (US)

(73) Assignee: The Johns Hopkins Unversity, Baltimore, MD (US)

( * ) Notice: Subject to any disclaimer, the term of this patent is extended or adjusted under 35 U.S.C. 154(b) by 0 days.

(21) Appl. No.: 09/842,508

(22) Filed: Apr. 26, 2001

Related U.S. Application Data

(60) Provisional application No. 60/199,696, filed on Apr. 26, 2000.

(51) Int. Cl.[7] ..... F41H 1/02
(52) U.S. Cl. ..... 2/2.5
(58) Field of Search ..... 2/2 A, 2 B, 2.5, 2/498

(56) References Cited

U.S. PATENT DOCUMENTS 3,793,648 A * 2/1974 Dorre et al. ..... 2/2.5
3,843,969 A * 10/1974 George et al. ..... 2/2.5
4,507,802 A * 4/1985 Small ..... 2/2.5
4,602,385 A * 7/1986 Warren ..... 2/2.5
5,073,985 A * 12/1991 Stone et al. ..... 2/2.5
5,331,683 A * 7/1994 Stone et al. ..... 2/2.5
5,398,340 A * 3/1995 Kibbee ..... 2/2.5
5,431,318 A * 7/1995 Garciia ..... 224/192
5,471,906 A * 12/1995 Bachner, Jr. ..... 2/2.5
5,472,769 A * 12/1995 Goerz, Jr. et al. ..... 428/138
5,495,620 A * 3/1996 Schoenweis ..... 2/2.5
6,029,270 A * 2/2000 Ost et al. ..... 2/2.5
6,175,958 B1 * 1/2001 Wu ..... 2/2.5
6,240,557 B1 * 6/2001 Bachner, Jr. ..... 2/2.5

* cited by examiner

*Primary Examiner*—John J. Calvert
*Assistant Examiner*—Robert H. Muromoto, Jr.
(74) *Attorney, Agent, or Firm*—Carla M. Krivak

(57) ABSTRACT

The present invention uses high thermal-conductivity materials to act as heat pipes around or through a soft body armor vest to transfer heat away from the body of the wearer. A moisture wicking layer is also incorporated and used to pull moisture from the body of the wearer and disperse the moisture to the outer surface where it can evaporate. An evaporative cooling effect, which is a one-way phase change process that is similar to that of the human body, removes thermal energy from the high thermal-conductivity materials at the outside surface of the vest dissipating the heat into the environment.

14 Claims, 3 Drawing Sheets

THERMAL CONTROL APPARATUS FOR BODY ARMOR

CROSS-REFERENCE TO RELATED APPLICATIONS

This application claims the benefit of prior filed co-pending U.S. Provisional Patent Application No. 60/199,696, filed on Apr. 26, 2000.

BACKGROUND OF THE INVENTION

The present invention relates to a system that removes heat and moisture from around the body of an individual wearing soft body armor.

With the increasing number and sophistication of threats to law enforcement officers today, the use of soft body armor is more and more critical. Evidence clearly shows that wearing body armor saves lives. Yet, many law enforcement officers choose not to wear soft body armor. Of the reasons officers use when choosing not to wear soft body armor, comfort, weight, fit, and heat build-up top the list. The discomfort, according to the officers, of wearing soft body armor outweigh the risks they perceive of getting shot.

While some of these complaints may be related to overall weight, fit or improper adjustment, complaints that armor makes the officers feel hot are not principally fit-related. The basic problem is that the ballistic protective layers are good thermal insulators and also block the ability to remove moisture. The impermeable surface area that a soft body armor vest covers is significant compared with the total area of the wearer's skin. Just six plies of fabric, waterproofed or not, are enough to block the evaporation of perspiration. The National Institute of Justice has issued Threat Levels I–IV in Standard 0101.04. This establishes six formal armor classification types as well as a seventh special type.

Threat Level II vests contain at least seven ballistic layers. Thus, it is safe to say that any soft body armor vest, regardless of level or waterproofing, will block perspiration. The weight added to the vest due to perspiration not only places an extra load on the wearer, but the moisture can degrade the ballistic properties of the soft body armor. The vest, therefore, imposes a true cost to the wearer in terms of his body's ability to cool itself.

While the industry has made major improvements over the past decade in overall weight and flexibility of the ballistic fabrics used, heat build-up and moisture retention have not been adequately addressed.

What is needed is a high-thermal-conductivity and moisture-wicking system that is either added to or integrated into a soft body-armor vest wherein heat and moisture are moved away from the body.

SUMMARY OF THE INVENTION

The present invention utilizes advanced materials, such as high thermal-conductivity graphite fibers and/or other high thermal-conductivity materials (metallic or non-metallic), to act as heat pipes, or paths, around body armor in order to transfer heat away from the body. The present invention also incorporates advanced moisture-wicking materials around the body armor to keep moisture away from the body and the body armor. In another embodiment, the high thermal-conductivity materials are integrated through the body armor vest, as opposed to traversing around, the soft body armor vest in order to transfer heat away from the body.

The present invention removes heat by transporting it along high thermal-conductivity fibers from the body-vest interface to the external environment, where it is removed by simple radiation and convection heat loss from the exterior of the vest. That is, the high thermally conductive fibers traverse the armor from an area next to the body to the exterior of the soft body armor vest through the inside of the vest. Because the external temperature influences the system behavior of the thermally conductive path, the higher the temperature humidity index (THI), the greater the difficulty in moving thermal energy out of the fibers and into the surrounding environment. After evaluating some basic heat transfer calculations, it became apparent that the required volume of conductive fibers of a given density, or more specifically the weight, needed to transport sufficient thermal energy would be larger than desired. To reduce the volume/weight of required fibers, the present invention uses the same process the body uses, namely, evaporative cooling. By using the perspiration that is currently generated under a vest, the present invention can improve the thermal coupling to the conductive fibers, create additional thermal capacity, and provide a cooling action through evaporation.

The present invention also utilizes a dual-faced overvest comprised of advanced moisture-wicking materials in order to pull moisture from the body of the wearer and from the body armor vest. Pulling moisture away from the body allows for a more comfortable experience by the wearer of the soft body armor vest. Pulling moisture away from the body armor vest minimizes any moisture induced mechanical effects on the ballistic cloth used in the body armor. The overvest acts like a wick, pulling moisture from the overvest/body interface and the overvest/body armor interface. The moisture is then moved to the outside surface of the overvest, where it can be dissipated by evaporative cooling. Additionally, a wetted (moisture wicking) material is coupled with the thermally conductive fibers to enhance heat extraction from the wearer's body. An evaporative cooling effect, which is a one-way phase change process that is similar to that of the human body, removes thermal energy from the conductive fibers at the external surface of the overvest dissipating the heat into the environment.

DESCRIPTION OF THE PREFERRED EMBODIMENTS

Figure 1:
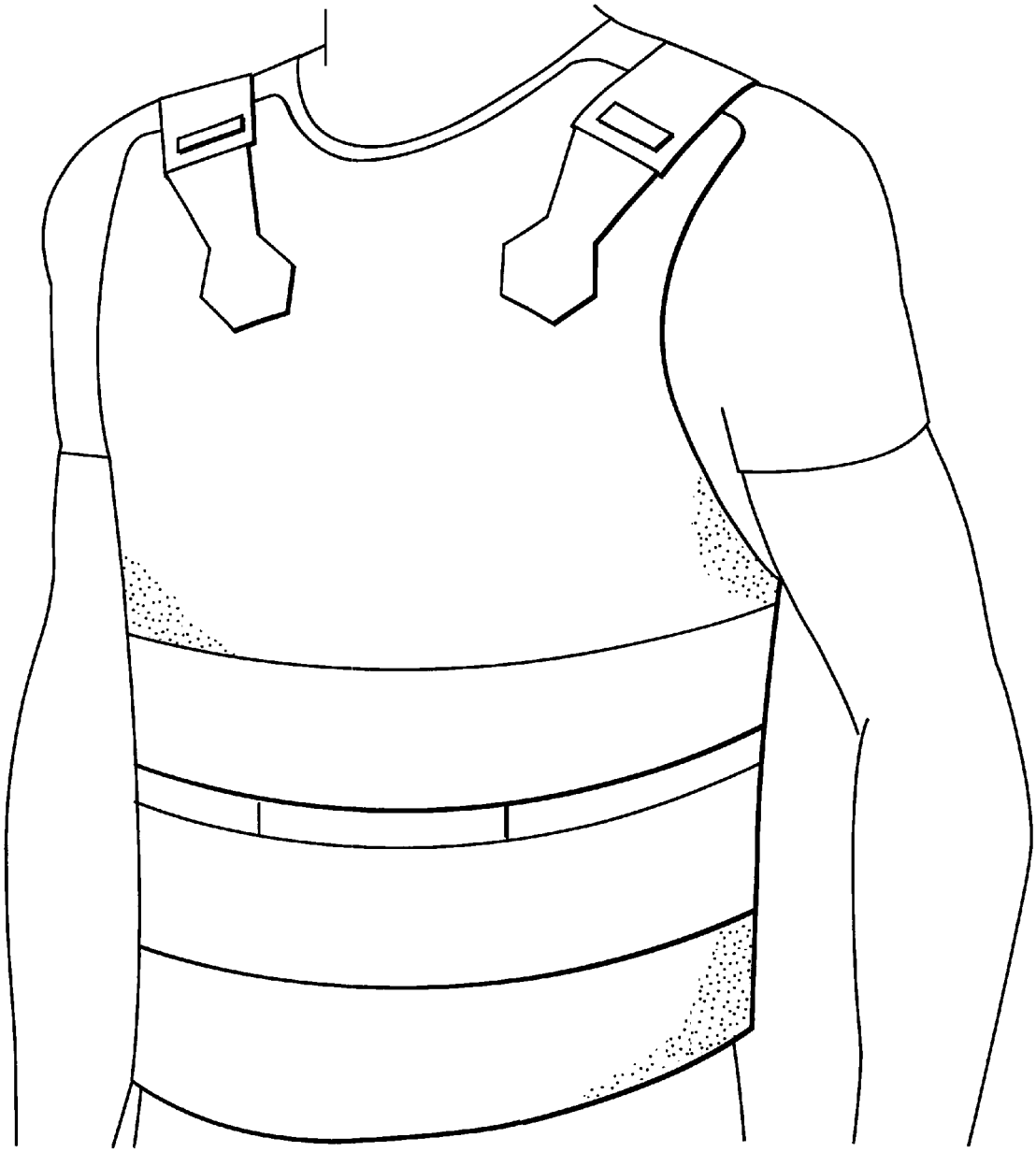
FIG. 1 illustrates one example of a prior art soft body armor vest.

FIG. 1 illustrates one example of a prior art soft body armor vest 10. Typically, a soft body armor vest 10 is comprised of a multi-layered ballistic layer and a water resistant shell (e.g., nylon or polyester). The water resistant shell is intended to prevent moisture from contacting the ballistic layers. Water (e.g., perspiration) can have a deleterious effect on the ballistic layers and could diminish the effectiveness of the soft body armor vest. The shell has compartments or cavities to hold the flexible ballistic panels which can be comprised of seven or more layers of Kevlar®, Spectra®, Twaron®, Dyneema®, Zylon®, or a combination of one or more in an assembly of a pattern or layer or weave. In some cases the ballistic layers are bonded or stitched in various patterns to improve performance. Most of the soft body armor models up through Threat Level III are designed to be worn concealed, commonly under an officer's uniform.

In general, the ballistic cloths insulate the body much like a winter coat, having relatively low thermal conductivity. Table 1 shows the relative thermal conductivity of a number of ballistic materials and some common clothing materials.

TABLE 1

| Material | Thermal Conductivity (W/m*K) |
|---|---|
| Kevlar | 0.04 |
| Spectra | 0.42 |
| Ballistic Nylon | 0.22–0.75 |
| Alumina Ceramic | 16–34 |
| Polypropylene | 0.14–0.39 |
| Cotton Wool | 0.06 |
| Leather | 0.16 |
| Aluminum | 170–225 |
| Copper | 360–400 |
| Graphite Fibers (Advanced Aerospace Materials) | |
| 30 Msi PAN (T-300) | 4 |
| 50 Msi PAN (M50J) | 62 |
| 75 Msi Pitch (P-75) | 200 |
| 120 Msi Pitch (P-120) | 700 |
| 130 Msi Pitch (K-13C) | 600–620 |
| K-1100 Pitch | 1170 |

Ballistic cloth is intended to be impermeable to moisture generated by the body. Trauma plates, if present, are typically a ceramic that has a better but still low thermal conductivity and are definitely impermeable to moisture. Trapped moisture magnifies the thermal discomfort of the wearer. If the ballistic cloth becomes soaked in water or perspiration, some fibers—particularly the aramid family (Kevlar®, etc.) experience a decrease in ballistic resistance. To minimize the moisture exposure of the ballistic cloth, some vests are designed with a moisture-resistant layer surrounding the ballistic cloth. This further reduces the ability of the vest to "breathe" thereby increasing the wearer's discomfort. Many vests are designed to allow the removal of the ballistic element so the shell can be laundered.

The human body needs to keep its internal temperature within somewhat narrow limits. Heat regulation in humans depends on a number of mechanisms. Excessive body heat is dispelled chiefly by increasing blood flow to the surface and extremities, by perspiring or panting, and by maximizing exposure of the skin to the surroundings. Perspiration, the body's primary cooling mechanism, is water given off by the intact skin, either as vapor by simple evaporation from the epidermis or as perspiration, a form of cooling liquid actively secreted from sweat glands. Perspiration is about 99% water, with small amounts of dissolved salts and amino acids. In extreme conditions, human beings can excrete several liters of perspiration in an hour. Thus, moisture retention of body armor is a significant issue for an wearer's level of comfort.

The thermal control (heat build-up) and moisture retention issues confronting soft body armor comfort are addressed by the present invention. One embodiment for thermal and moisture control requires no alterations to current soft body armor vest designs. This is referred to as the overvest embodiment. The overvest embodiment is attractive because it can be applied immediately to a wide variety of styles and models of soft body armor currently available. Basically the soft body armor vest is placed into an overvest of the present invention.

Another embodiment integrates thermal control directly into the soft body armor vest by weaving high thermal-conductivity materials through, as opposed to around, the vest. This embodiment provides for enhanced thermal control because the high thermal-conductivity materials do not need to carry heat as great a distance and are thus more efficient. This embodiment is not geared for adaptation with existing vests. Rather, it is incorporated into new soft body armor vests.

Figure 2B:
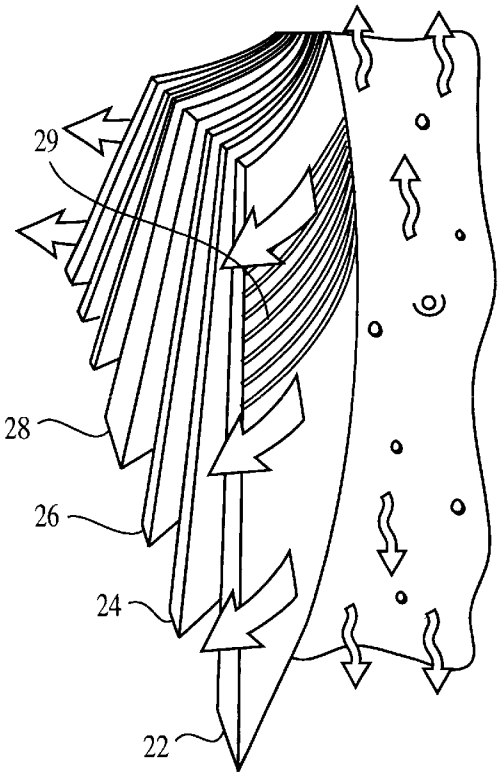
FIG. 2B illustrates the overvest/soft body armor combination being worn.
Figure 2A:
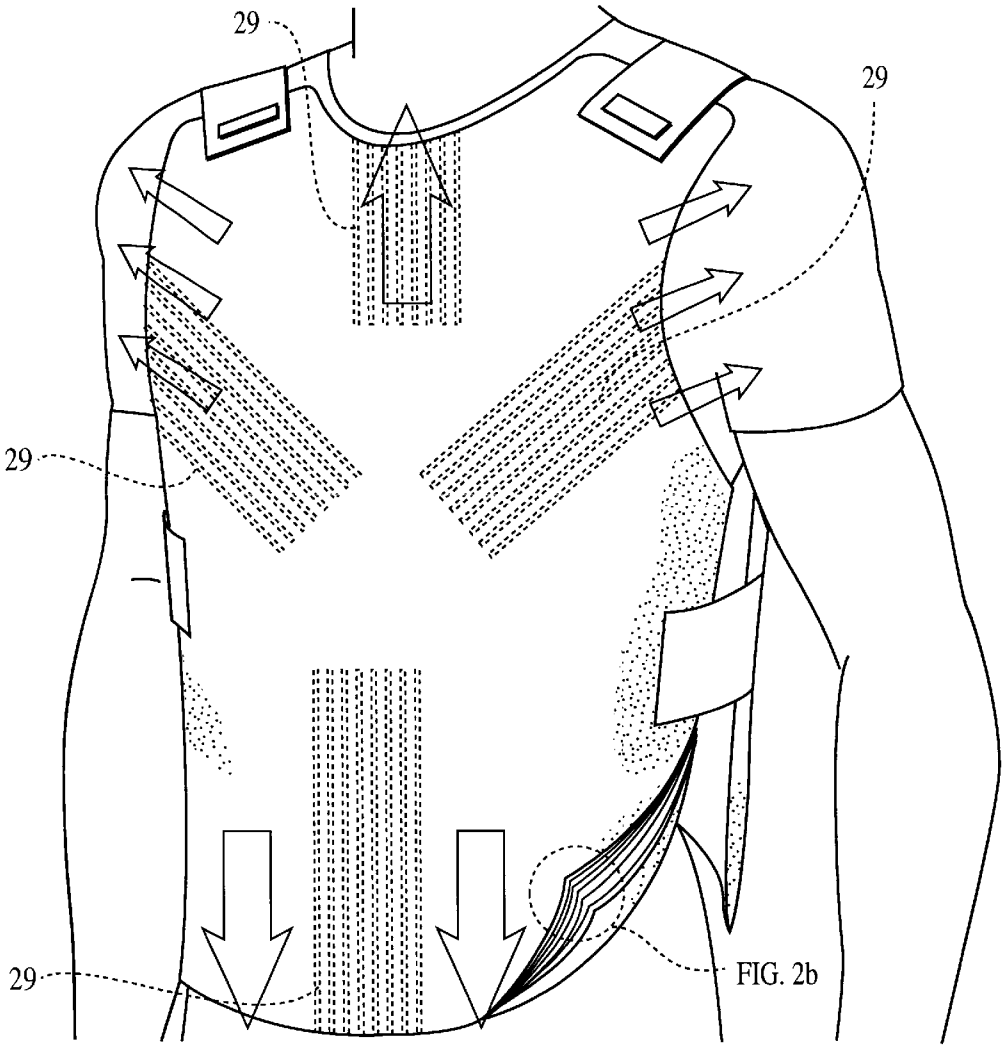
FIG. 2A illustrates a cross-section view of the overvest embodiment of the present invention used to relieve heat build-up and moisture retention incidental to wearing a soft body armor vest.

FIGS. 2A and 2B illustrate an overvest embodiment of the present invention used to relieve heat build-up and moisture retention incidental to wearing a soft body armor vest.

FIG. 2A is a cross-section view of the soft body armor vest illustrating the various layers that comprise the vest as a whole. Viewing the cross-section from the body outward, the inner layers are as follows: a thermally conductive carrier layer 22, a moisture wicking layer 24, a carrier layer 26, and a ballistic layer 28. The remaining layers comprise the outer surfaces of the layers just listed. Thus, after the ballistic layer 28 is the outer surface of the carrier layer 26 followed by the outer surface of the moisture-wicking layer 24 and finally the outer surface of the thermally conductive carrier layer 22.

The thermally conductive carrier layer 22 and the moisture wicking layer 24 comprise the overvest while the remaining layers are typical of a prior art soft body armor vest. The overvest is designed to snugly encapsulate the existing soft body armor vest. The soft body armor vest can be placed into the overvest, the overvest can be wrapped around the soft body armor, etc. It is the function of the overvest to provide thermal and moisture control.

The thermally conductive carrier layer 22 is merely a netting, webbing, or other water resistant fabrication designed to hold a set of high thermal-conductivity fibers 29 in place.

FIG. 2B illustrates the overvest/soft body armor combination being worn. The lines and arrows illustrate the high thermal-conductivity fibers 29 and the intended direction of heat flow. The high thermal-conductivity fibers 29 have a thermal conductivity along the fiber direction that is up to four times greater than that of copper depending on the type of fiber being used (See, Table 1 infra). Such fibers 29 transfer heat from hotter areas to cooler areas. For purposes of the description and claims herein, inside surface shall refer to the surface closest to the body while outside surface shall refer to the surface that is exposed to the environment. The fibers 29 are placed in the thermally conductive carrier layer 22 that covers the inside surface and some portion of the outside surface of the soft body armor by any known method. To minimize weight and possible motion constriction, the fibers are placed as a pattern of conductive strips or tows (i.e., a bundle of parallel fibers) that run along the inside surface of the vest and exit through the neck, arms and waist folding over onto the outside surface of the vest. In order to locate and retain their relative position, the high thermally-conductivity fibers 29 are bonded or sewn onto thermally conductive carrier layer 22 which is a flexible cloth. Alternatively, or additionally to, the high thermal-conductivity fibers 29 are woven into the structure of the flexible cloth thermally conductive carrier layer 22.

As heat builds up incident to wearing the soft body armor vest, the high thermal-conductivity fibers 29 transfer as much heat as possible along the fiber line leading to the external surface of the vest. Once the heat reaches the external surface it is passively radiated into the surrounding environment. This process is continuously ongoing while the vest is being worn and excess heat is built up.

To further enhance the heat transfer process, a wetted (moisture wicking) material can be coupled with the thermally conductive fibers 22 to enhance heat extraction from the body.

Moisture control is achieved passively using a cooling evaporative process. Since perspiration evaporating is how a body cools itself, the faster a fabric spreads moisture aids the evaporative process and cools the body better. Advanced moisture-wicking materials such as Intera® fabrics have a hydrophilic (water loving) molecule bonded to the surface of the fiber. This molecule attracts water and spreads it out over a broad area. Since the water (perspiration) is spread out it evaporates faster and therefore cools the body better and faster. In contrast, cotton is hot because it is cellular like a sponge and therefore holds water so it does not aid in spreading out sweat. Plain synthetics are hot because they are oil based and therefore hydrophobic (water hating). Perspiration goes nowhere because it is stuck between skin and fabric.

Moreover, water absorbs heat energy or cold energy. If it is cold and you have moisture against your skin, the moisture will absorb the cold energy from the outside environment and therefore make you cold. Conversely, if it is hot and you have moisture against your skin, the moisture will absorb the hot energy from the outside environment and therefore make you hot.

Moisture control in the present invention works by using moisture-wicking materials such as Intera® or Coolmax® to draw moisture away from the body of the wearer and, if necessary, the body armor. These materials then move the moisture to the outer surface where the moisture evaporates naturally. The moisture-wicking material is fabricated into a layer that fits around an existing soft body armor vest and is bonded to the thermal conductive carrier layer. Moreover, the layer can be dual faced such that it draws moisture from the body and the body armor.

Figure 3B:
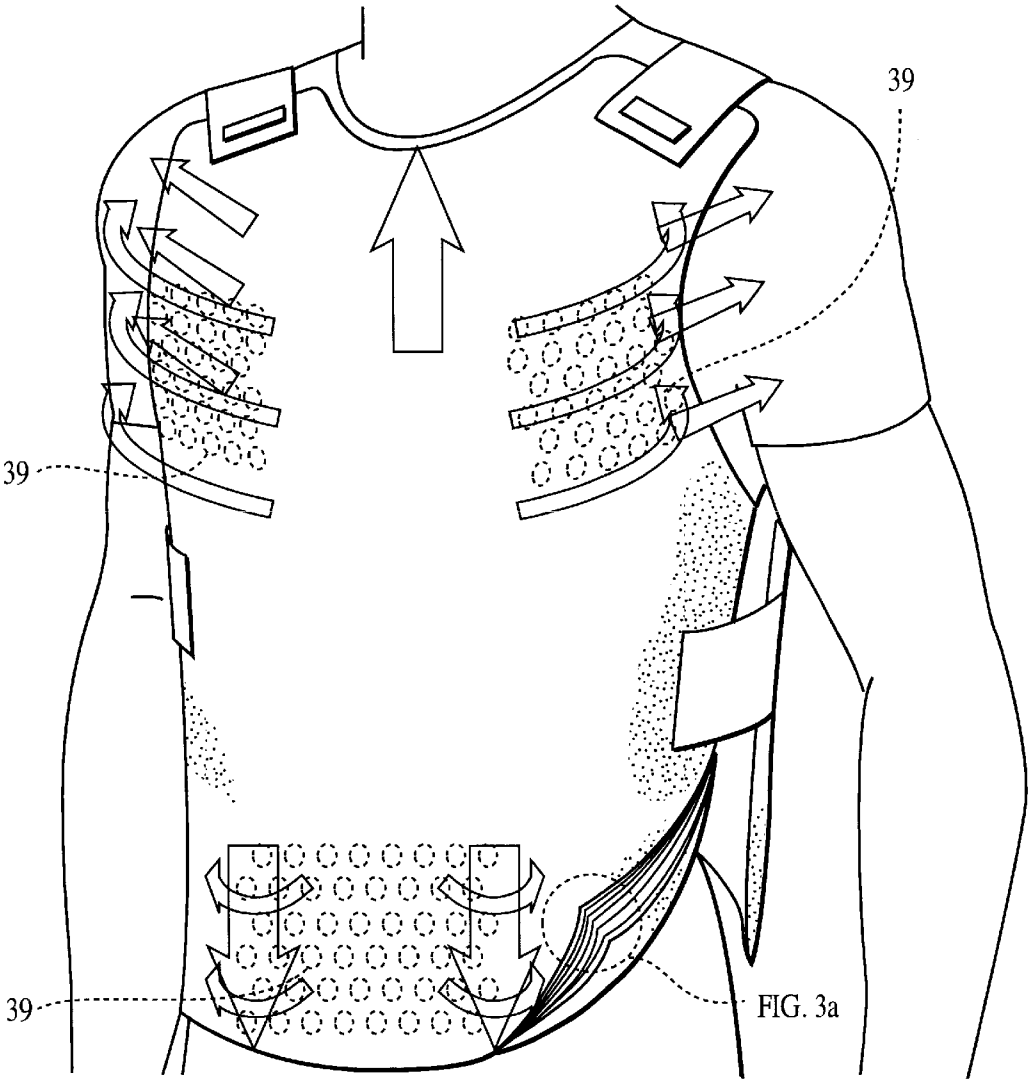
FIG. 3B illustrates the integrated soft body armor vest being worn.
Figure 3A:
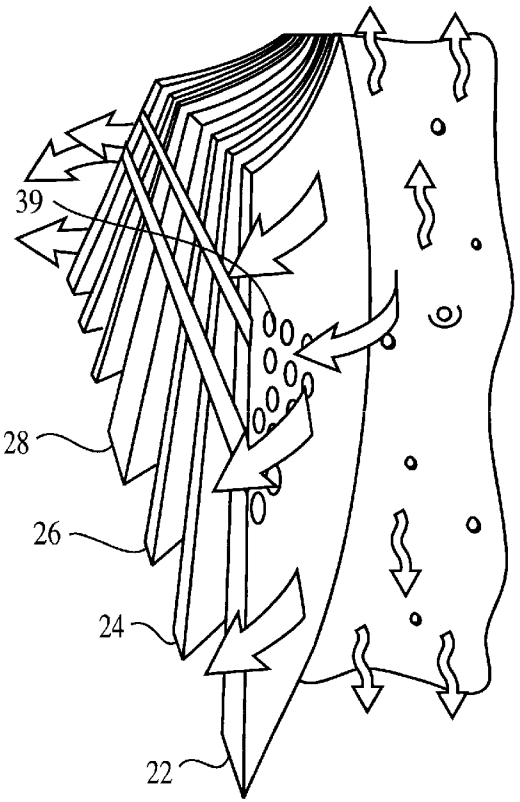
FIG. 3A illustrates the integrated embodiment of the present invention used to relieve heat build-up and moisture retention incidental to wearing a soft body armor vest.

FIGS. 3A and 3B illustrate an integrated embodiment of the present invention used to relieve heat build-up and moisture retention incidental to wearing a soft body armor vest.

FIG. 3A is a cross-section view of the integrated soft body armor vest illustrating the various layers that comprise the vest as a whole. Viewing the cross-section from the body outward, the inner layers are the same as shown for the overvest embodiment and are as follows: a thermally conductive carrier layer 22, a moisture wicking layer 24, a carrier layer 26, and a ballistic layer 28. The remaining layers comprise the outer surfaces of the layers just listed. Thus, after the ballistic layer 28 is the outer surface of the carrier layer 26 followed by the outer surface of the moisture-wicking layer 24 and finally the outer surface of the thermal conductive carrier layer 22. In contrast to the overvest embodiment, the thermal conductive carrier layer 22 and the moisture wicking layer 24 are integrated into the soft body armor vest to present a single unit. Also shown are high thermal-conductivity fibers 39 that penetrate the vest at various locations.

FIG. 3B illustrates the integrated soft body armor vest being worn. The lines and arrows illustrate the high thermal-conductivity fibers 39 and the intended direction of heat flow.

As in the overvest embodiment, the thermally conductive carrier layer 22 is a water resistant fabrication designed to hold a set of high thermal-conductivity fibers 39 in place. In the integrated embodiment, however, the high thermal-conductivity fibers 39 do not of the vest but travel through the vest instead. This is achieved using any known method such as piercing or needling fibers through a thick mat or woven construct. The primary advantage to having the high thermal-conductivity fibers 39 travel through the vest is that the fibers need not be as long as in the overvest embodiment. As a result, they can transfer heat more efficiently leading to greater thermal control and comfort. The high thermal-conductivity fibers 39 are rigid by nature. As such, the high thermal-conductivity fibers 39 should not be oriented directly outward through the vest because upon impact with a projectile they can be forced back and be projected inward needle-like into the body. As shown in FIG. 3A, the high thermal-conductivity fibers 39 are placed at an outward angle relative to the body. Thus, if struck by a projectile, the high thermal-conductivity fibers 39 will not be forced into the body like a needle.

As heat builds up incident to wearing the soft body armor vest, the high thermal-conductivity fibers 39 transfer as much heat as possible along the fiber line leading to the external surface of the vest. Once the heat reaches the external surface it is passively radiated into the surrounding environment. This process is continuously ongoing while the vest is being worn and excess heat is built up. Since the high thermal-conductivity fibers 39 do not have to travel as far to reach the outside surface, heat can be dissipated at a greater rate as compared to the overvest embodiment.

Moisture control for the integrated embodiment works the same way as in the overvest embodiment. The advanced moisture wicking materials attract moisture and spread it out until it reaches the outer surface where it evaporates.

Another feature that can be implemented with both the overvest and integrated embodiments of the present invention is means for moving air across the outside surface of the vest to enhance the evaporative effect (not shown). The air moving means comprises a series of chambers incorporated into the inner portion of the overvest between the overvest and the soft body armor carrier. Or, in the integrated embodiment, the chambers are placed between the moisture wicking layer and the ballistic layer closer to the inner surface of the vest. These chamber can be manufactured by any known method such as those used by the company Dielectrics. The chambers can comprise two layers of fabric or film that are impermeable to air flow. In addition, the chambers include two distinct one way openings, one for taking air into the chamber and one for letting air out of the chamber. Each chamber is filled with an open-cell foam that has sufficient strength to cause the chamber to expand, drawing in air when the person wearing the body armor exhales. The intake openings in each chamber are designed with a one way valve, such that when the chamber is expanded, air from the area around the body enters the chamber. When the person inhales and compresses the chamber, that air is forced out through a second set of one way valve openings through a passage or flat tube to the front side of the overvest. The exiting air is made to blow over the moisture laden moisture wicking material through multiple orifices. The net result is an increase in the evaporative process. Moreover, the use of already warmed air from the area between the body armor and the torso adds to the effectiveness of this process. Another beneficial side effect is the harder a person exerts them self, the harder this mechanism will work to help cool them because chest expansion and contraction is more pronounced under exertion.

Thus, the present invention provides a light weight yet effective body armor that does not require batteries, recharging of phase change material, etc. Further, the overvest or vest portions are washable. The present invention provides both moisture wicking and heat transfer in a light weight, yet effective way, so that the weave is comfortable and the person wearing the body armor feels as if they are wearing regular clothing.

In the following claims, any means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A thermal and moisture control overvest for use with a soft body armor vest wherein said overvest is designed to encapsulate said soft body armor vest, said overvest comprising:

a thermally conductive carrier layer that encapsulates said soft body armor vest;

high thermal-conductivity fibers held in place within said thermally conductive carrier layer such that said high thermal-conductivity fibers traverse the surface of said soft body armor vest and transfer heat from the inner surface of said soft body armor vest to the outer surface of said soft body armor vest where said heat is dissipated into the environment; and a moisture wicking layer bonded to said thermally conductive carrier layer that draws moisture from the body and causes the moisture to spread to the outer surface of the soft body armor vest where the moisture evaporates.

2. The overvest of claim 1 wherein said high thermal-conductivity fibers are metallic.

3. The overvest of claim 1 wherein said high thermal-conductivity fibers are non-metallic.

4. The overvest of claim 1 wherein said high thermal-conductivity fibers are graphite.

5. The overvest of claim 1 wherein said moisture wicking layer is dual-faced also drawing moisture from the vest as well as the body and causing the moisture to spread to the outer surface of the soft body armor vest where the moisture evaporates.

6. The overvest of claim 1 further comprising means for moving air across the outside surface of the moisture wicking layer in to enhance the evaporative effect.

7. The overvest of claim 1, further comprising moisture wicking material coupled to the high thermal-conductivity fibers for enhancing heat extraction from the body.

8. A soft body armor vest having thermal and moisture control characteristics, comprising:

a thermally conductive carrier layer;

a ballistic layer;

a moisture wicking layer bonded to said thermally conductive carrier layer, said moisture wicking layer drawing moisture from the body and causing the moisture to spread to the outer surface of the soft body armor vest where the moisture evaporates; and high thermal-conductivity fibers attached to said thermally conductive carrier layer, said high thermal-conductivity fibers transferring heat from the inner surface of said soft body armor vest through the moisture wicking layer and ballistic layer to the outer surface of said soft body armor vest where said heat is dissipated into the environment.

9. The soft body armor vest of claim 8 wherein said high thermal-conductivity fibers are metallic.

10. The soft body armor vest of claim 8 wherein said high thermal-conductivity fibers are non-metallic.

11. The soft body armor vest of claim 8 wherein said high thermal-conductivity fibers are graphite.

12. The soft body armor vest of claim 8 wherein said moisture wicking layer is dual-faced, drawing moisture from the vest as well as the body and causing the moisture to spread to the outer surface of the soft body armor vest where the moisture evaporates.

13. The soft body armor vest of claim 8 further comprising means for moving air across the outside surface of the moisture wicking layer in to enhance the evaporative effect.

14. The soft body armor vest of claim 8 wherein a moisture wicking material is coupled with said high thermal-conductivity fibers to enhance heat extraction from the body.

* * * * *